US006802603B1

(12) United States Patent
Montagutelli

(10) Patent No.: US 6,802,603 B1
(45) Date of Patent: Oct. 12, 2004

(54) DEVICE FOR UNLOCKING A COMPARTMENT OF AN OPENING MECHANISM

(75) Inventor: Denis Montagutelli, Montreuil (FR)

(73) Assignee: Societe A.P.S. Engineering S.A.R.L, Paris (FR)

( * ) Notice: Subject to any disclaimer, the term of this patent is extended or adjusted under 35 U.S.C. 154(b) by 23 days.

(21) Appl. No.: 10/030,150

(22) PCT Filed: Jun. 26, 2000

(86) PCT No.: PCT/FR00/01783

§ 371 (c)(1),
(2), (4) Date: Aug. 29, 2002

(87) PCT Pub. No.: WO01/03939

PCT Pub. Date: Jan. 18, 2001

(30) Foreign Application Priority Data

Jul. 9, 1999 (FR) ..... 99 09312

(51) Int. Cl.[7] ..... B41J 29/13

(52) U.S. Cl. ..... 347/108; 400/693; 400/613; 400/120.16

(58) Field of Search ..... 347/108, 2; 400/693; 296/37.12; 292/336.3

(56) References Cited

U.S. PATENT DOCUMENTS 5,779,371 A * 7/1998 Aoyama et al. ..... 400/120.16
6,474,883 B1 * 11/2002 Kawakami et al. ..... 400/613

FOREIGN PATENT DOCUMENTS

JP 301270 * 10/2001

* cited by examiner

*Primary Examiner*—Stephen D. Meier
*Assistant Examiner*—Ly Tran
(74) *Attorney, Agent, or Firm*—Westerman, Hattori, Daniels & Adrian LLP

(57) ABSTRACT

The invention concerns a device for unlocking a compartment of an opening mechanism, comprising a frame, the compartment being designed to receive a paper roll, and being closed with a cover (10). The invention is characterised in that a lever (22) is mounted rotating on the cover (10) and comprises a manoeuvring part (24), the lever (22) comprising stop elements (30) capable of co-operating with the sides of the frame to cause the cover (10) to rotate relative to the frame when the lever (22) is rotated relative to the cover (10). The invention is applicable to opening mechanisms for thermal printing machines.

11 Claims, 3 Drawing Sheets

DEVICE FOR UNLOCKING A COMPARTMENT OF AN OPENING MECHANISM

The present invention involves a device for unlocking a compartment of an opening mechanism, and in particular, of a thermal printing mechanism, the unlocking device being designed to make it easier to load and unload the paper used in a thermal printing device of this type.

The printing mechanisms are generally made up of a printing head affixed to a frame. The thermal printing head comprises a ceramic support that carries the line of heating points and silicon chips or integrated circuits for controlling their supply. The printing head can pivot relative to the frame, most generally along an axis parallel to a longitudinal side of the frame. A roller is united as a single piece with the frame in a manner so that its longitudinal axis is also parallel to it on a longitudinal side of the frame. The printing head is held by a spring supported on the roller. The position of the roller must thus be perfectly controlled in order to obtain a perfect alignment with the thermal printing head. The printing medium usually consists of a roll of paper whose one side is sensitive to heat. This printing roller is driven in rotation by means of a drive cylinder, also called a drive capstan, which itself is activated by a system of pinions and by a small electric motor.

In the case of opening mechanisms for thermal printing devices, the compartment designed to accommodate the roll of paper is closed by a cover that is made of one or more articulated parts, whereby the cover supports the printing roller and makes it possible to bring the printing roller into contact with the chassis.

The locking of the roller onto the printing head is done by a spring united with the chassis that brings the roller into contact with the printing head and between which, the paper to be printed becomes inserted.

The pressure of the printing head on the roller enables the system to be locked in a closed position, either by a condition on the respective positions of the axis of rotation of the cover and the support direction of the printing head, or by a condition on the shape of the spring or on the shape of the chassis.

In order to be reliable, the known locking systems require a large enough pressure of the printing head on the roller in order to ensure a correct alignment between the printing head and the roller, and in order to not be able to open very easily, for example, during a drop or a jolt or when tension is exerted on the paper.

The fact of exerting such pressure in order to ensure closing, this pressure being exerted against a relatively sizeable resistance, does not generally pose a problem to the user, since it is always sufficient to press on the cover to close it. On the other hand, it happens that the force to be exerted in order to open the cover is also relatively sizeable. The action for opening the cover consists in pulling on the cover at the positions provided with grooves for this purpose. The sizeable force to be exerted can thus result in a sudden uncoupling of the cover, which can result in its breaking. On the other hand, these mechanisms are generally of a small size, in a manner such that the user is not very inclined to exert a sizeable pulling force on these mechanisms, which poses an ergonomic problem. Moreover, if the user does not pull on the cover in the direction that is absolutely perpendicular to its axis of rotation, the cover will twist or break, so that the printing device itself can no longer function correctly.

The present invention applies in this context and its purpose is to propose a thermal printing device in which the cover of the compartment intended to receive the paper roll can be maneuvered in the opening direction as in the closing direction in a simple manner and without making sizeable forces necessary, whereby the opening and closing mechanism only has to consist of a reduced number of parts so as not to have a negative influence on the cost of such a printing device and on its reliability.

For this purpose, the present invention has as its object a device for unlocking a compartment of an opening mechanism, in particular, a thermal printing mechanism, comprising a chassis, the compartment being designed to receive a paper roll, and being closed by a cover.

According to the present invention, a lever is mounted to rotate on the cover and comprises a maneuvering part, whereby the lever consists of stops able to act together with the sides of the chassis in order to cause the rotation of the cover relative to the chassis when the lever is rotated relative to the cover.

According to a characteristic of the present invention, the maneuvering part of the lever is housed in an opening of the cover.

Preferably, the opening is formed on the median part of its main side and receptacles are formed on the portions that extend perpendicularly to the main side of the cover.

According to a characteristic of the invention, the receptacles are formed between the openings designed to act together with pins united with the chassis and allowing the cover to rotate relative to the chassis and with slots designed to receive the ends of the axle of a support and drive roller for paper delivered from the paper roll.

In an advantageous manner, the lever comprises a maneuvering part, having a shape that is approximately complementary to that of the opening of the cover, and it is equipped with extensions carrying at their free ends, rotating axes intended to come to engage in the receptacles formed in the cover, and stops intended to act together with the sides of the chassis.

Other purposes, characteristics, and advantages of the present invention pertain more specifically to the description that follows, of an embodiment example given as an illustration, in reference to the attached drawings in which.

In the Figures, a thermal printing mechanism is shown which comprises a compartment intended to receive a paper roll, whereby this compartment is closed by a cover itself equipped with a locking device intended to make it easier to load and unload the paper used in such a thermal printing device, the opening of the cover being made easier by a lever made according to the present invention. The thermal printing mechanism is quite similar to the one that has been described in the document FR-A-2 760 684 in the name of the applicant, the contents of which are assumed to be integrated by reference in the present description and which is thus not described in greater detail.

Figure 3:
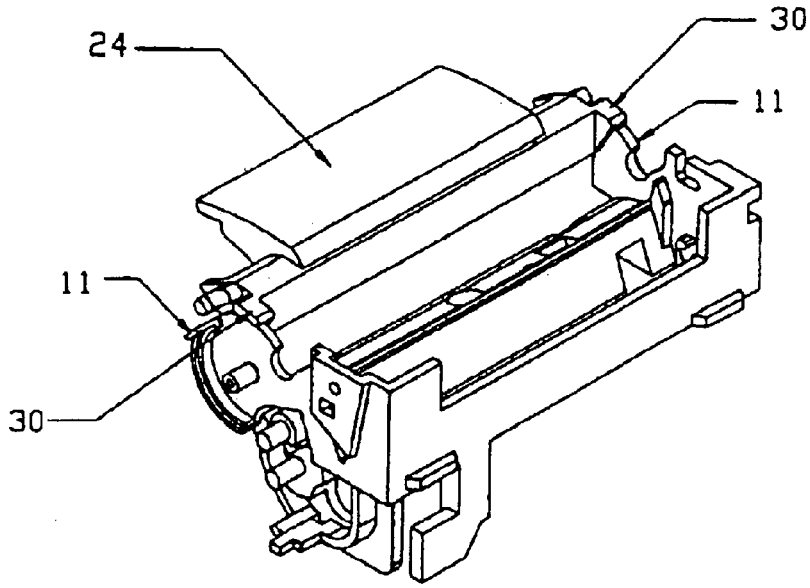
FIG. 3 shows a perspective view of the printing chassis and the lever shown in FIG. 2, the cover being omitted for clarity.
Figure 4:
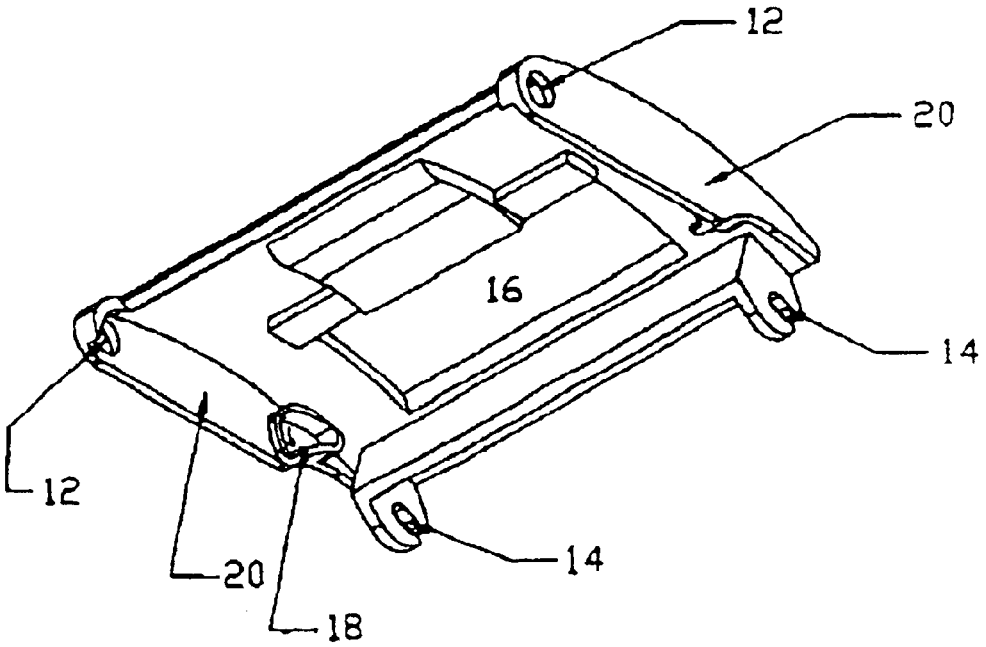
FIG. 4 shows a perspective view of the cover for guarding the compartment intended to receive the paper roll, seen from below from an angle other than the one in FIG. 1.

Shown in the Figures are the cover of the compartment intended to receive the paper roll, the cover being designated in its entirety by the reference indicator 10. The cover 10 is of the general rectangular configuration and comprises, at the ends of one of its sides, of the openings 12 intended to receive the pins (not shown) that are united with the chassis whose sides are partially shown on FIG. 3 by reference 11 and allow the swinging or the rotation of the cover 10 on the chassis. The cover 10 comprises, on the ends of the side opposite the one that carries the openings 12, the slots 14 intended to accommodate the ends of the axle of a support and drive roller (not shown) of the paper delivered from the paper roll (not shown).

The cover 10 is equipped on the median part of its main side with an opening 16, having a general rectangular shape, and receptacles 18 formed on the portions 20 that extend perpendicularly to the main side between the openings 12 and the slots 14.

Figure 1:
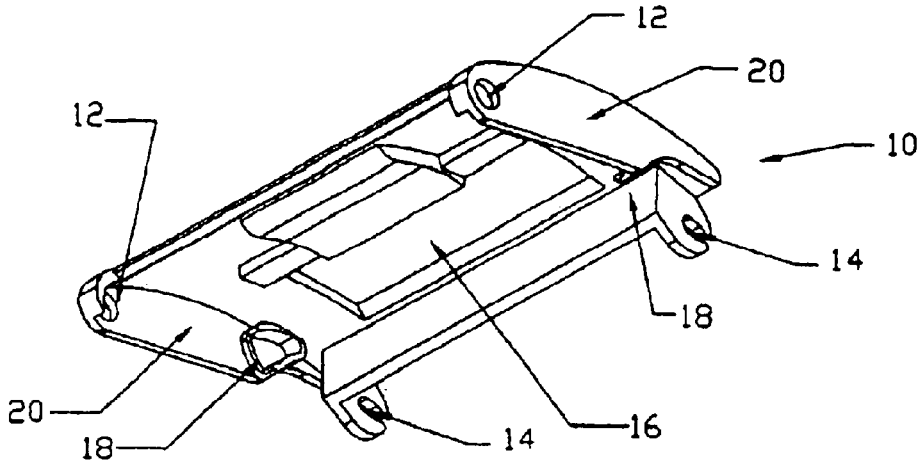
FIG. 1 shows a perspective view of the cover for guarding the compartment intended to accommodate the paper roll, seen from below.
Figure 2:
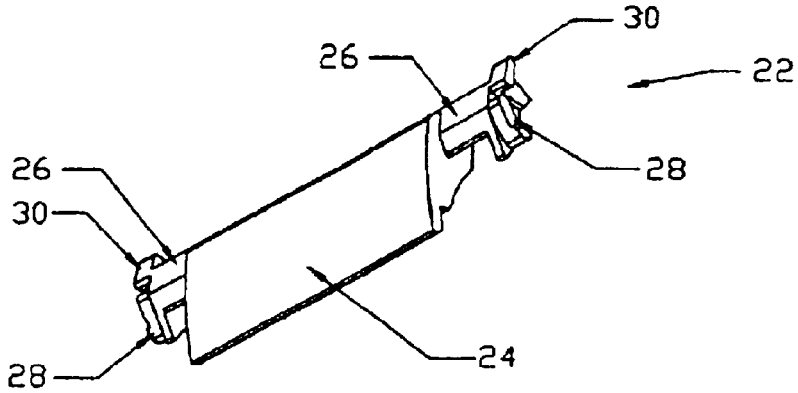
FIG. 2 shows a perspective view of the lever that equips the cover of FIG. 1, seen in two-thirds view from behind.
Figure 5:
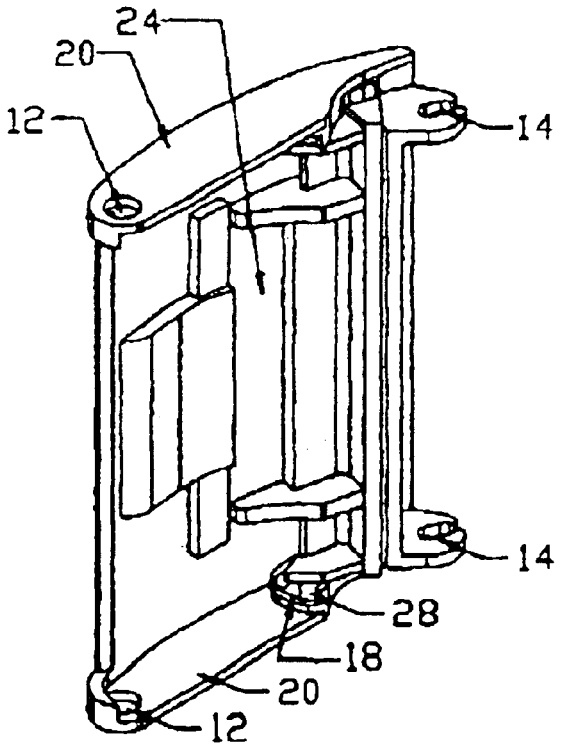
FIG. 5 shows a perspective view of a cover for guarding the compartment intended to receive the paper roll, seen from below and equipped with the lever according to the present invention, the lever being positioned in a closed position.
Figure 6:
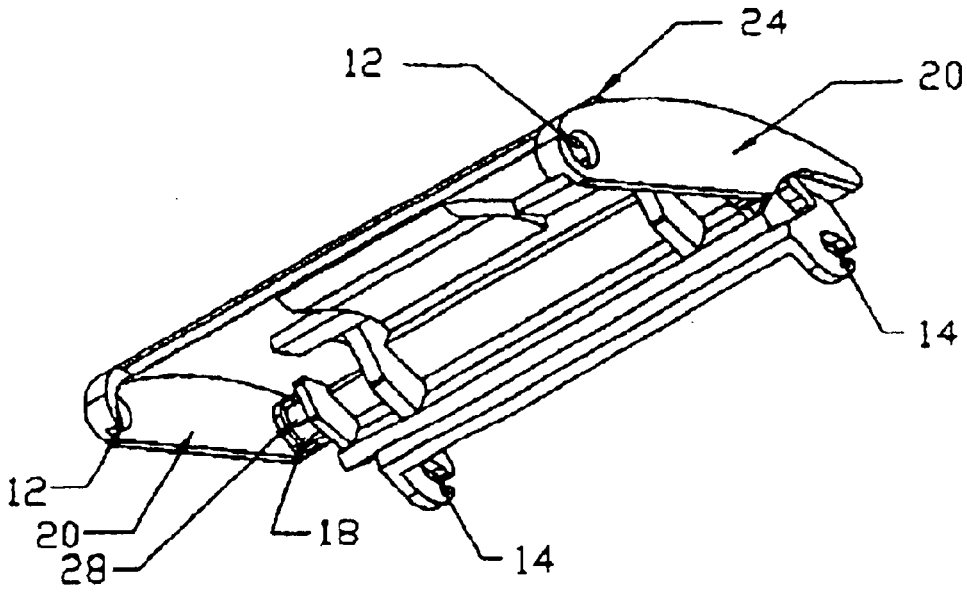
FIG. 6 shows a perspective view of a cover for guarding the compartment intended to receive the paper roll, seen from below and equipped with the lever according to the present invention, the lever in an open position.
Figure 7:
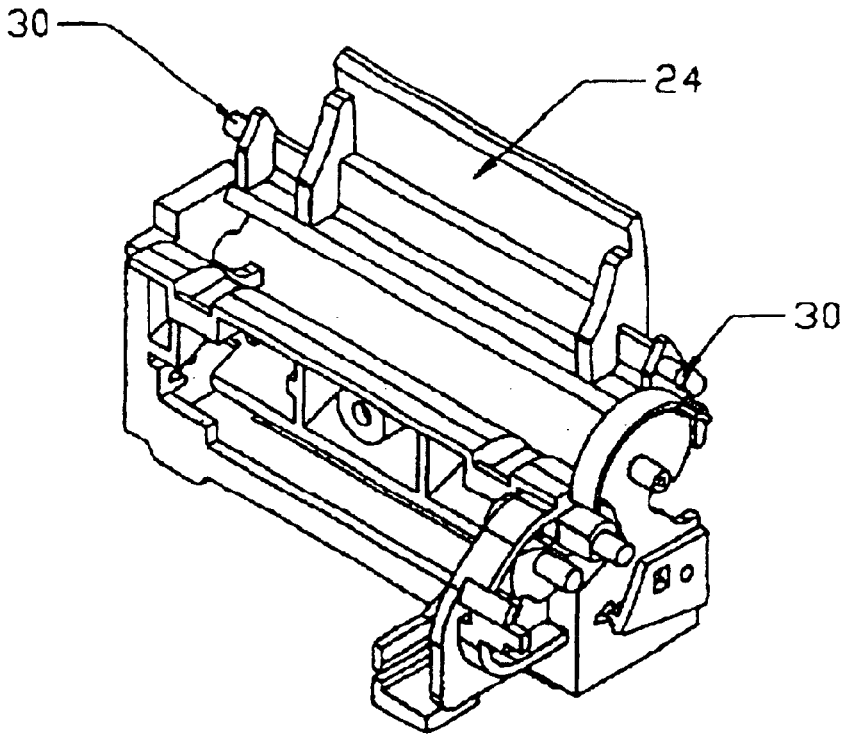
FIG. 7 shows a perspective view of the printing chassis and of the lever shown in FIG. 2 at an angle other than FIG. 3.

According to the present invention, a lever, shown in greater detail on FIG. 2, and designated in its entirety by the reference indicator 22, consists of a main part 24, having a shape that is approximately complementary to that of the opening 16 of the cover 10, and forming a maneuvering part. The lever 22 is equipped on the ends of one of its large sides with extensions 26 which themselves carry, at their free ends, rotating axes 28 and stops 30. The rotating axes 28 are intended to engage by clamping in the receptacle 18 formed in the cover 10, as shown in FIGS. 5 and 6.

As has just been seen, the lever 22 is affixed by clamping into the cover 10, the rotating axes 28 of the lever 22 being engaged by force in the receptacles 18 of the cover 10. This cover can then be installed on the chassis of the thermal printing mechanism by the intermediary of the openings 12 arranged around the pins united with the chassis.

The cover can then be closed simply by pressure on it. In fact, the lever is free in the cover and does not present any obstacle to this closing movement.

When the user intends to cause the cover to open, in order to install a new paper roll or replace the one that was present before in the compartment closed by the cover 10, he only needs to grasp the lever 22 by its maneuvering part 24, slightly going past the upper side of the cover 10. To do this, he only needs to intercept the lever using a fingernail or the end of a pointed instrument. The lever 22 then pivots relative to the cover 10 by the rotating axes 28 free to turn in the receptacles 18 of the cover 10.

The first time of the rotational movement of the lever 22 relative to the cover 10, the stops 30 come to be supported on the sides of the chassis. The second time of the rotational movement of the lever 22 relative to the cover 10, the force exerted by the user at the end of the maneuvering part 24 is exerted by the stops 30 on the sides of the chassis, this force being reduced by the ratio between the lever arms existing between, on the one hand, the end of the maneuvering part 24 and the rotating axes 28, and on the other hand, between the rotational axes 28 and the stops 30. As can be seen in the Figures, the ratio between these lever arms can be very sizeable, up to about 3 as shown in the Figures, and in a preferred manner, greater than ten. The opening of the cover 10 can thus be done in particularly ergonomic manner for the user, who does not have to exert a sizeable force in order to obtain this opening.

Thus, according to the present invention, a thermal printing device has been made in which the cover of the compartment intended to receive the paper roll can be maneuvered in the opening direction as in the closing direction in a simple manner and without requiring sizeable forces, the opening and closing mechanism only consisting of a single piece, playing simultaneously the roles of a grasping or maneuvering instrument, a rotating axis of the lever relative to the cover, and a lever stop of the chassis. Such a lever thus has a particularly reduced cost, just like the cover that it is intended to equip, in a manner so that the cost price and the reliability of the printing mechanism is not altered by it.

Of course, the invention is not limited to the embodiment modes that have been described, but it is able, on the contrary, to accommodate numerous modifications that would occur to the professional without leaving its framework.

What is claimed is:

1. Device for unlocking a compartment of an opening mechanism, in particular, a thermal printing mechanism, comprising a chassis, the compartment being designed to receive a paper roll, and being closed by a cover, wherein a lever is mounted to rotate on the cover and comprises a maneuvering part, whereby the lever comprises stops able to act together with sides of the chassis in order to cause the rotation of the cover relative to the chassis when the lever is rotated relative to the cover.

2. Device for unlocking according to claim 1, wherein the maneuvering part of the lever is accommodated in an opening of the cover.

3. Device for unlocking according to claim 2, wherein the opening is formed on the median part of a main side of the cover, and receptacles are formed on portions that extend perpendicularly to the main side of the cover.

4. Device for unlocking according to claim 3, wherein the receptacles are formed between (i) openings allowing the cover to rotate relative to the chassis and (ii) slots designed to receive the ends of the axle of a support and drive roller for paper delivered from the paper roll.

5. Device for unlocking according to claim 3, wherein the maneuvering part of the lever has a shape that is approximately complementary to that of the opening of the cover, and wherein the lever is equipped with extensions carrying at their free ends rotating axles intended to come to engage in the receptacles formed in the cover, and stops intended to act together with the sides of the chassis.

6. Device for unlocking according to claim 1, wherein the stops come to be supported on the sides of the chassis when a user exerts a force on the maneuvering part of the lever.

7. Device for unlocking according to claim 1, wherein the force exerted by a user on the maneuvering part of the lever is transmitted by the stops to the sides of the chassis.

8. Device for unlocking according to claim 7, wherein this force is reduced by a ratio between a lever arm between the end of the maneuvering part and a rotation axis of the lever and a lever arm between the rotation axis of the lever and the stops.

9. Device for unlocking according to claim 8, wherein this ratio is at least three.

10. Device for unlocking according to claim 8, wherein this ratio is greater than ten.

11. Device for unlocking according to claim 1, wherein the lever rotates freely with respect to the cover.

* * * * *